United States Patent [19]

Weber

[11] 4,417,182

[45] Nov. 22, 1983

[54] MOVING FLUTTER ILLUSION ELECTRIC LIGHT CONTROLLER

[76] Inventor: Harold J. Weber, 20 Whitney Dr., Sherborn, Mass. 01770

[21] Appl. No.: 174,913

[22] Filed: Aug. 4, 1980

[51] Int. Cl.[3] ..... H05B 37/02; H05B 39/04

[52] U.S. Cl. ..... 315/210; 315/209 R; 315/287; 315/294; 315/317; 315/313; 315/323; 315/320

[58] Field of Search ..... 315/186, 209 R, 210, 315/246, 250, 268, 217, 272, 287, 294, 312, 313, 317, 320, 208, 323; 362/810

[56] References Cited

U.S. PATENT DOCUMENTS

| | | | |
|---|---|---|---|
| 3,778,676 | 12/1973 | Keller | 315/217 |
| 4,159,442 | 6/1979 | Komatsu | 362/810 X |
| 4,284,926 | 8/1981 | Dinges | 315/210 X |

*Primary Examiner*—Eugene R. Laroche
*Assistant Examiner*—Vincent DeLuca

[57] ABSTRACT

An electric light controller means particularly adapted for use with an array of lamps to produce a distinctive "fluttering" effect, which is the combined visual sense of movement wrought by a sequential chaser together with the substantially random flickering effect associated with a natural flame. The controller is particularly useful in decorative display arrangements, including advertising displays, theatre marquees, and the like for the purpose of attracting attention and notice.

19 Claims, 6 Drawing Figures

MOVING FLUTTER ILLUSION ELECTRIC LIGHT CONTROLLER

BACKGROUND OF INVENTION

The use of sequential lighting circuits, e.g. "chaser lights" has been known for years. Such novelty lighting has always been appealing for movie theatre marquees, casinos, night clubs, and the like. Also such moving effect lighting has achieved commercial popularity as the accompaniment with with certain kinds of popular music (i.e., "rock", "disco", etc.) and is used by concessions which make their business from such mediums.

Sequential "chaser" lighting, whether "moving" or "back and forth" is inherently uninteresting and monotonous even after brief exposure thereto. The movement illusion is also hypnotic and can have a dulling effect on patrons, as well as the employees, or establishments using such lighting methods to any great extent.

An interesting lighting effect is also produced by lights which "flicker", producing the appearance of an open natural flame. Such an effect is widely fluctuant, usually being generated by a pseudorandom control signal source. In particular Bergeson in U.S. Pat. No. 4,064,414 entitled "Apparatus for Simulating the Light Produced by a Fire" and Weber in U.S. Pat. No. 4,253,045 entitled "Flickering Flame Effect Electric Light Controller" describes such flame effect controllers. The dramatic effect, while quite pronounced and attractive, is not particularly attention-getting when compared with chaser lights. Therefore the use of the flickering light is usually limited to quieter, more genteel applications such as romantic settings in lounges and restaurants, decorative drive-way lamps (post lanterns), and chandeliers for example.

The unique combination of the best qualities of both earlier teachings has wrought the improved lighting means herewithin described which has all the quality of dramatic movement inherent in a sequential chaser light system coupled with the exciting variety of lighting variation inherent in a flickering light system.

SUMMARY

An electric light controller is provided which combines the effect produced by a flickering open flame with the sense of movement effect produced by a sequential "chaser" light array. The combined result is an enhanced sense of dynamic and highly dramatic light fluctuation which may best be described as a "moving flutter", which in the sense of the illumination produced, is busily astir.

The controller combines the sequential, ordered switching in steps between two or more electric lamps which induces the visual illusion of movement, with the relatively random on and off switching of the overall lighting effect in rapid succession so as to produce a visual effect of "flicker" in any individual lamp element. These two combined signals produce variative signals which act to turn the individual members of a light bulb array off and on in accord with the signal's instant value.

The useful effect may be further controlled in overall brightness by way of a "lamp dimmer" function, as an integral part of the apparatus.

Still further control is provided by a photocell which acts to turn the controller off and on in accord with the ambient light conditions.

DESCRIPTION OF DRAWINGS

The instant invention is illustrated with four sheets of drawings including six figures.

DESCRIPTION OF INVENTION

Figure 1:
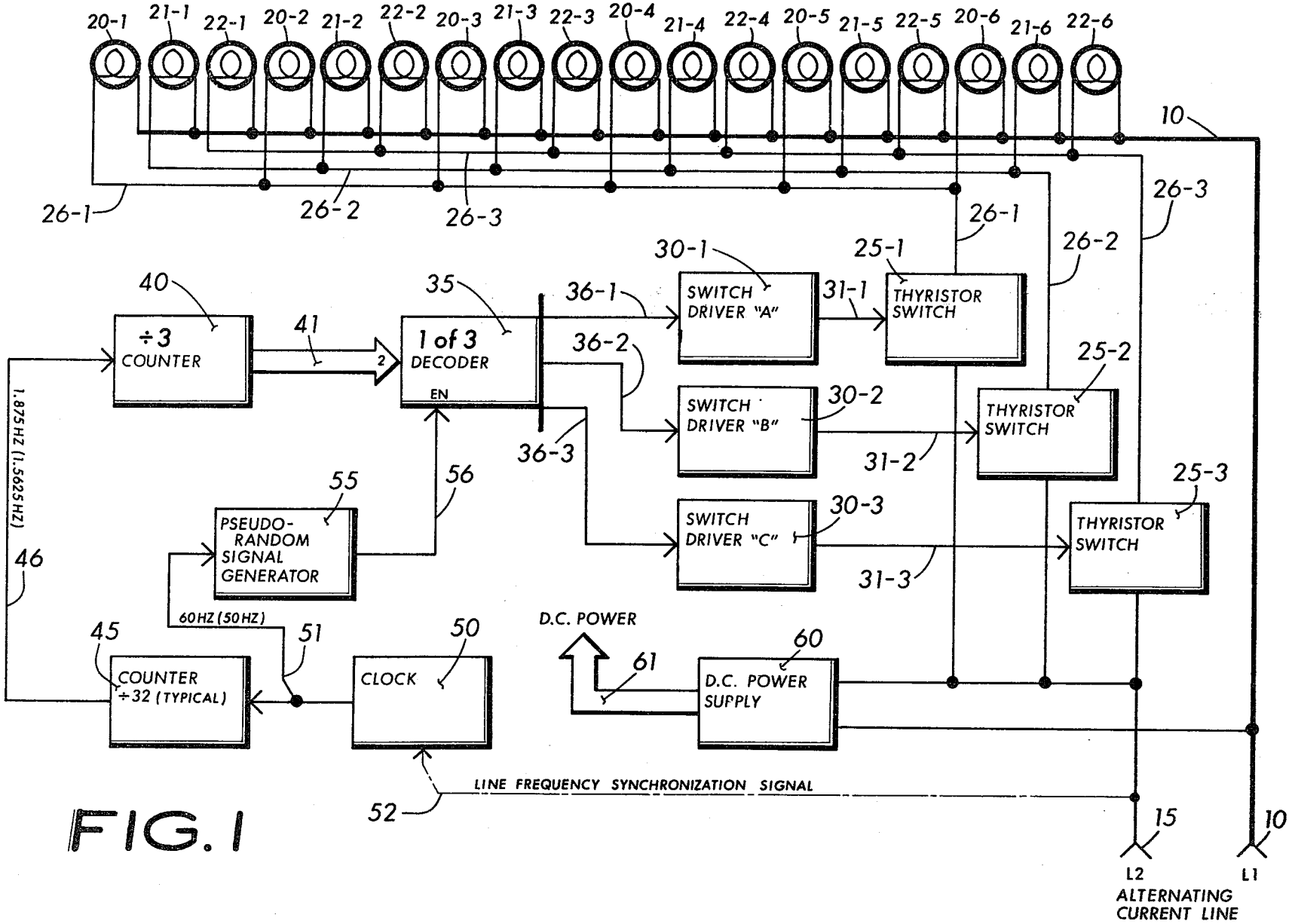
FIG. 1—Function diagram shows distinctive elements comprising the essence of the invention.

The gist of the invention is shown in FIG. 1. A source of electric power couples L1 via line 10 to the common connection of a seriate plurality of adjacent electric lamps; and L2 via line 15 couples to several switches 25-1, 25-2, 25-3 on to the other side of the electric lamps by lines 26-1, 26-2, 26-3. The many light bulb elements 20-1 through 20-6, 21-1 through 21-6, and 22-1 through 22-6 are sequentially coupled thereto. The electric power also couples with a d.c. power supply 60, providing d.c. power 61 which operates the "clock" function 50, producing a train of clock pulses therefrom which may be snychronized 52 with the alternating current power line frequency. This clock pulse signal couples with a counter 45, producing an output 46 therefrom of about 1.88 hertz. This signal 46 couples with a sequential counter 40, e.g. a binary divide-by-three function as shown. The output is a two-bit signal which decodes 35 by a unitive means into a sequential one-of-three outputs 36-1, 36-2, 36-3 each coupled with respective switch drivers 30-1, 30-2, 30-3 providing a varative control pulse signal 31-1, 31-2, 31-3 to thyristor switches 25-1, 25-2, 25-3. The result is the load control lines 26-1, 26-2, 26-3 will turn-on in accord with the following sequence, ad infinitum:

| CLOCK STATE | LINE 26-1 | LINE 26-2 | LINE 26-3 |
|---|---|---|---|
| 1 | ON | OFF | OFF |
| 2 | OFF | ON | OFF |
| 3 | OFF | OFF | ON |
| 4 | ON | OFF | OFF |
| 5 | OFF | ON | OFF |
| 6 | OFF | OFF | ON |
| 7 | ON | OFF | OFF |
| . | . | . | . |
| . | . | . | . |
| . | . | . | . |
| . | . | . | . |
| n1 | ON | OFF | OFF |
| n2 | OFF | ON | OFF |
| n3 | OFF | OFF | ON |

The clock signal 51 also couples with the pseudorandom signal generator 55, the purpose for which is to produce a pseudorandom sequence binary signal 56, coupled to the ENable input of the decoder 35. The state of the binary bits 56 enable the sequnetial binary signals 41, or over-ride the pulses to disable all of the decoder outputs 36-1, 36-2, 36-3 at the same time. This acts to modify the resulting switch ON states to retain inherently sequential pattern, but to be over-ridden by the pseudorandom pulses. The effect of the pseudorandom pulses is to introduce a "flickering" effect, e.g. an erratic mode, into the resulting lighting illusion, which when combined with the sequential effect, produces an overall "fluttering" effect which is distinctive and unique.

The extent of this fluttering effect may be controlled by the varying of the effective clock rate signal at the input of the counter 40, or generator 55, either separately or in various combinations.

The resulting effect, interpreted by the human eye and senses, is a complex illusion, combining the exciting movement of the sequential "chaser" lighting effect with that of the busy flutter of a natural, say gas lit, flame lamp.

Figure 2:
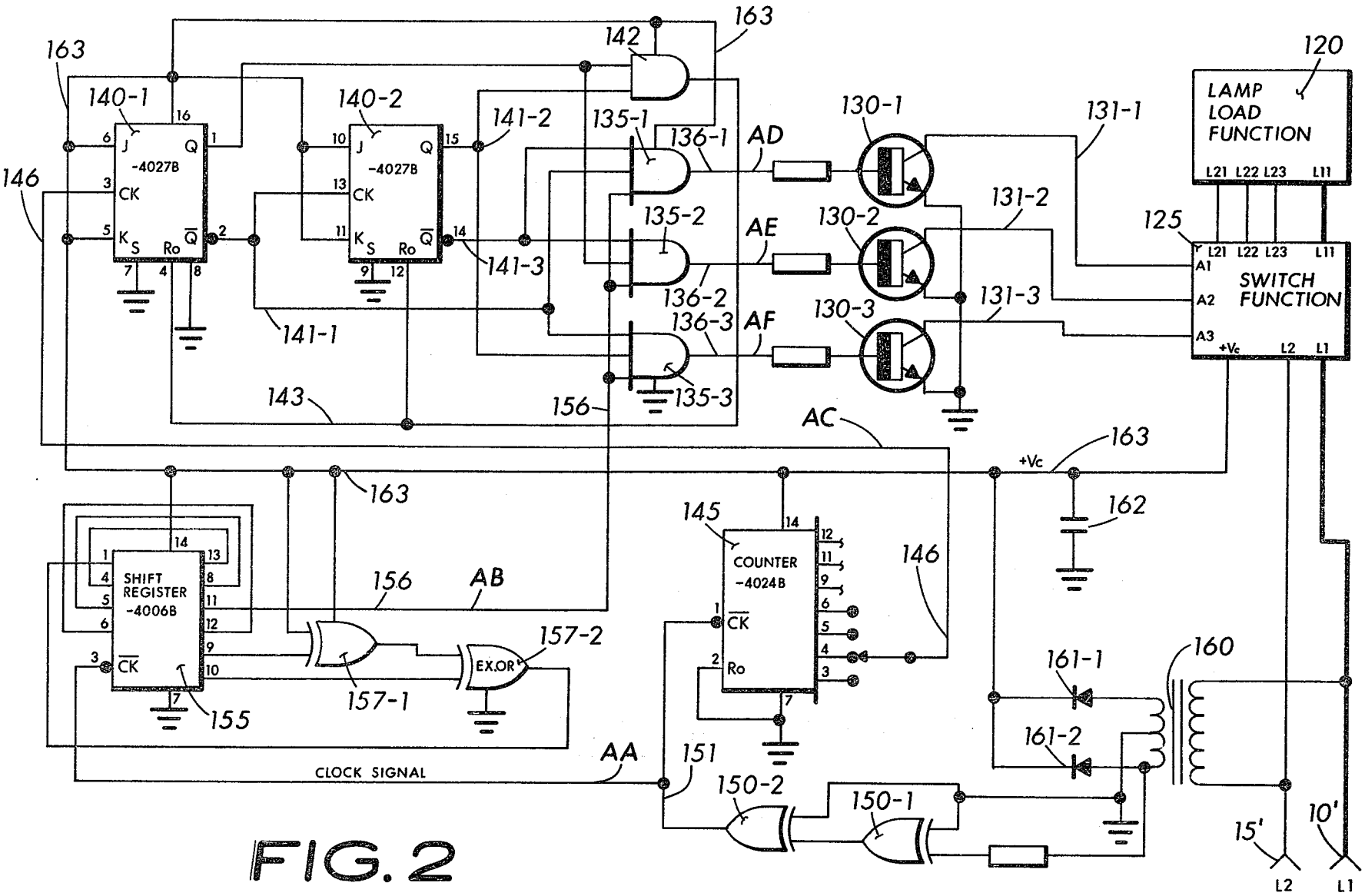
FIG. 2—Schematic circuit for a 1-2-3 sequential chaser combined with a pseudorandom flicker generator for driving an array of electric lamps arranged in groups of three.

The circuit for a particular embodiment is depicted in FIG. 2. The a.c. line connects to the switch function 125 and transformer 160 by lines 10', 15'. Rectifiers 161-1, 161-2 provide $+V_c$ power 163, developed across filter capacitor 162. The transformer 160 secondary a.c. signal is "squared", e.g. wave-shaped, into a clock signal 151 by cascaded inverters 150-1, 150-2. The clock signal couples with the counter 145 CK input, which acts as a variable (selectable) count frequency divider, producing a frequency on the order of 2 hertz on line 146 coupled with the CK input of J-K flip-flop 140-1, which together with flip-flop 140-2 act as a divide-by-three function. The resulting outputs 141-1, 141-2, 141-3 are decoded as:

| STEP NO. | 140-1 Q | 140-1 $\overline{Q}$ | 140-2 Q | 140-2 $\overline{Q}$ | GATE |
|---|---|---|---|---|---|
| 1 | 0 | (1) | 0 | (1) | 135-1 |
| 2 | (1) | 0 | 0 | (1) | 135-2 |
| 3 | 0 | (1) | (1) | 0 | 135-3 |

into three sequential control signals 136-1, 136-2, 136-3, coupled to NPN transistors 130-1, 130-2, 130-3. The ON state collector current accordingly couples 131-1, 131-2, 131-3 with switch function 125. Gate 142 completes the counter's divide-by-three reset function: e.g., when the counter momentarily enters into its fourth binary state, it is instantly reset 143 by the gate.

The clock signal 151 also couples with the CK input of a multistage shift register 155, shown as a C-MOS type CD-4006B integrated circuit. The overall circuit configuration, including inverter 157-1 and gate 157-2 is that of a pseudorandom pulse generator of known form. A pseudorandom binary signal appears on line 156 which couples with AND gates 135-1, 135-2, 135-3. The gates act as a unitive means which pass the sequential pulses 141-1, 141-2, 141-3 when the signal 156 is HIGH, whereas all pulses 141-1, 141-2, 141-3 are blocked when signal 156 is LOW. The result is the variative control pulse signals on lines 136-1, 136-2, 136-3 will not be strictly sequentially repetative, but rather they will be erratically sequentially repetative in accord with the pseudorandom signal 156. The result is the lamp function 120 will appear to be substantially sequential, as in a "chaser" circuit, but the individual lamps will "flicker" which is increasingly interesting as an overall illusory effect to the eye.

Figure 3:
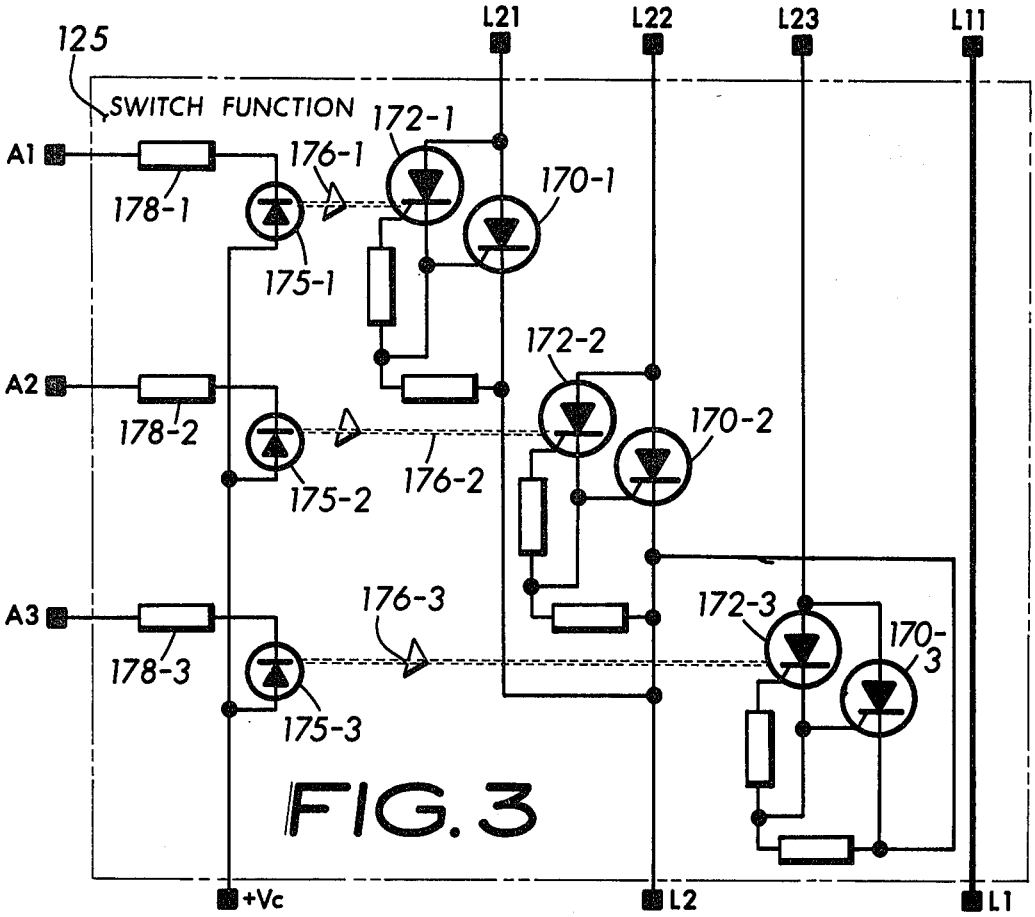
FIG. 3—Operative detail for the switch function associated with FIG. 2.

The switch function 125 appears in FIG. 3, being recited for clarity as a preferred embodiment. The inputs A1, A2, A3 couple with the transistor 130-1, 130-2, 130-3 collectors in FIG. 2. When the respective collector "saturates", current will flow from the $+V_c$ source through a correspondent light-emitting diode 175-1, 175-2, or 175-3 and ballast resistor 178-1, 178-2, or 178-3. The resultant light energy coupling 176-1, 176-2, 176-3 actuates a "light activated silicon controlled rectifier" (LASCR) 172-1, 172-2, 172-3. The compound connection of the LASCR with the power silicon controlled rectifier (thyristor) 170-1, 170-2, 170-3 allows power to flow between line input L2 and the respective load connections L21, L22, L23, whilst the load returns through L11 to L1.

The distinct advantage afforded is good isolation between the high electric power voltages and the low control function voltages brought about by the optical coupling. This helps the constructor to manufacture a safe apparatus, one which may more easily meet the stringent safety considerations expected by many underwriting agencies, especially in the electrical advertising and display field.

Figure 4:
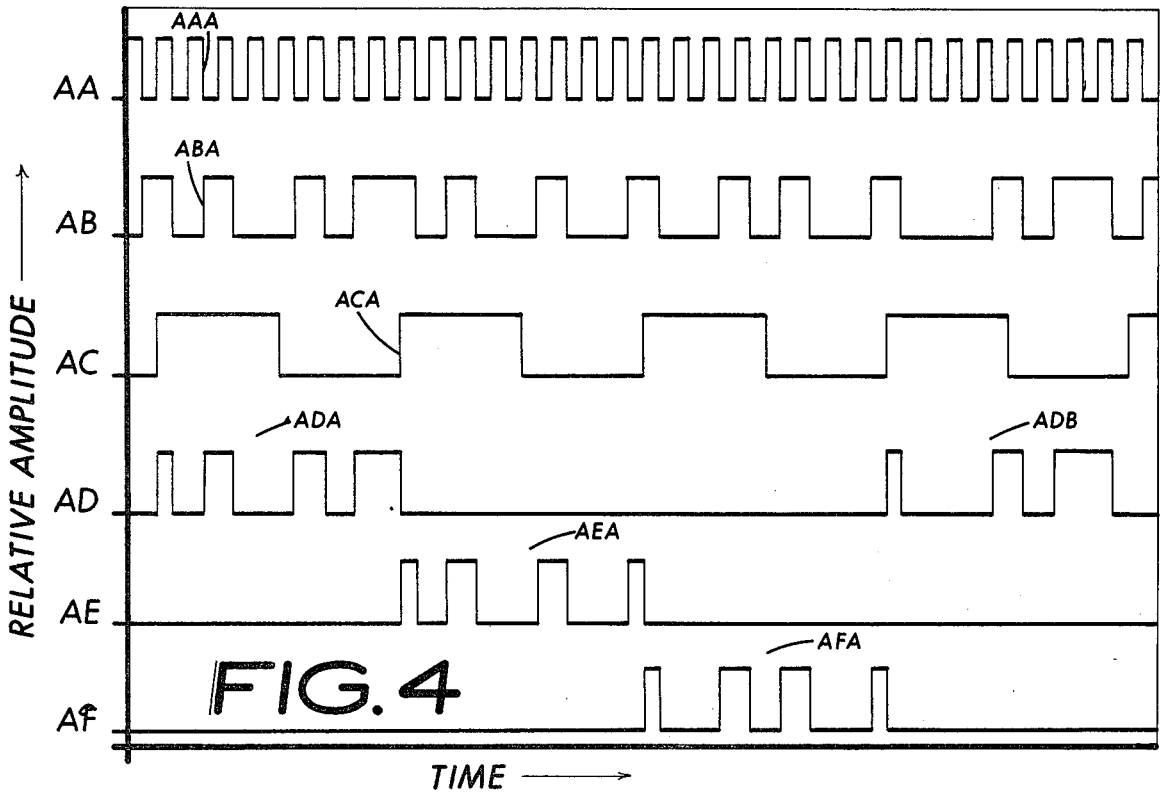
FIG. 4—Electric waveforms for various circuit functions of the circuit in FIG. 2.

The waveforms of FIG. 4 depict the typical electrical signals present in the circuit taught by FIG. 2. Wave AA shown the clock signal. The negative edge AAA produces a state change in both the counter 145, producing a signal like that of AC; and the shift register 155, producing a signal like that of AB albeit myrid combinations are available. Both the transistions typified by ABA, ACA are shown to occur on the clock negative transistion AAA. The "1-2-3" sequence, combined with the pseudorandom signal AB is distinctly shown on the three variative control pulse signal outputs AD, AE, AF. The unique "random" structure of each sequential pulse burst is shown distinctly by the makeup of ADA relative to ADB, and also relative to AEA and AFA. This "erratic" variation is what brings about the interesting new lighting effect. Also, since the pulse edges AAA are line synchronized, all transistions of signal state occur near zero line voltage, producing a zero crossing switching effect in the shown configuration. The result is less electrical switching noise and a better line power factor.

Figure 5:
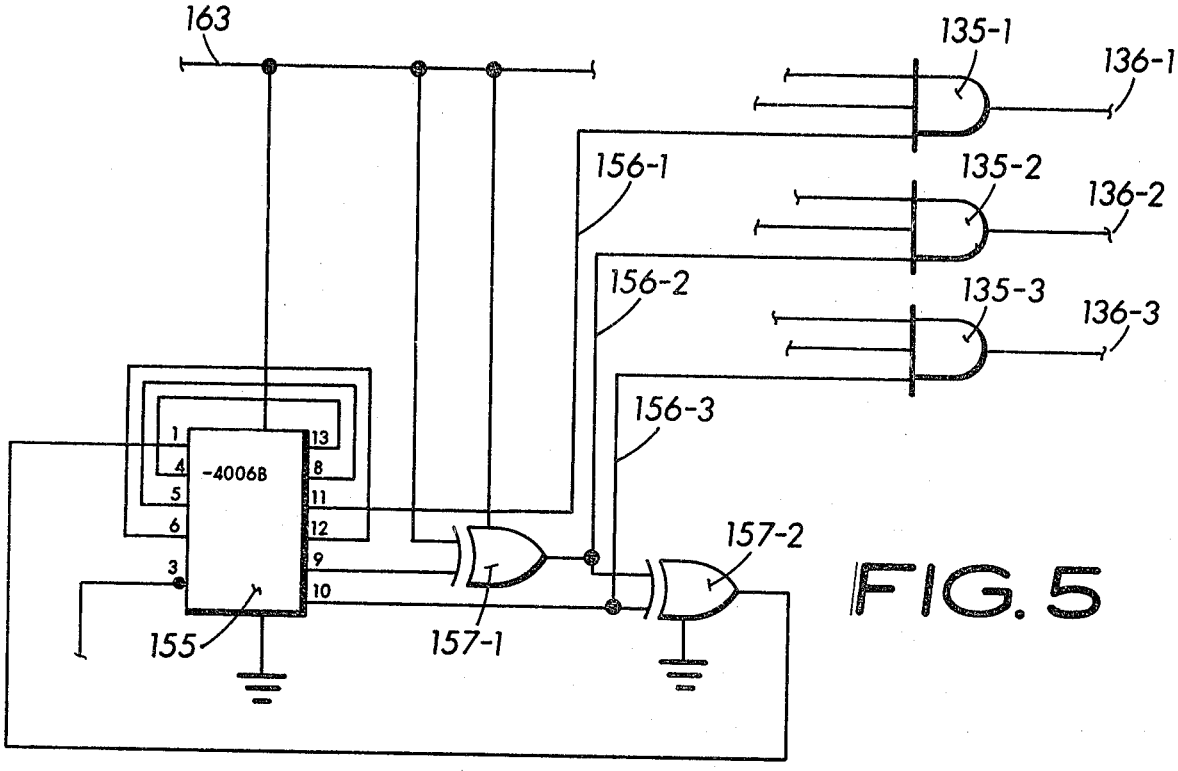
FIG. 5—Circuit detail for implementing multitudinous flicker signal control of the lamps with the circuit in FIG. 2.

Somewhat different "flutter" effect in the overall lighting appearance is produced by the configuration of FIG. 5. Three distinct outputs 156-1, 156-2, 156-3 from the pseudorandom generator coupled individually with the unitive gates 135-1, 135-2, 135-3. The result is each variative signal 136-1, 136-2, 136-3 will have a distinctly different routine.

Figure 6:
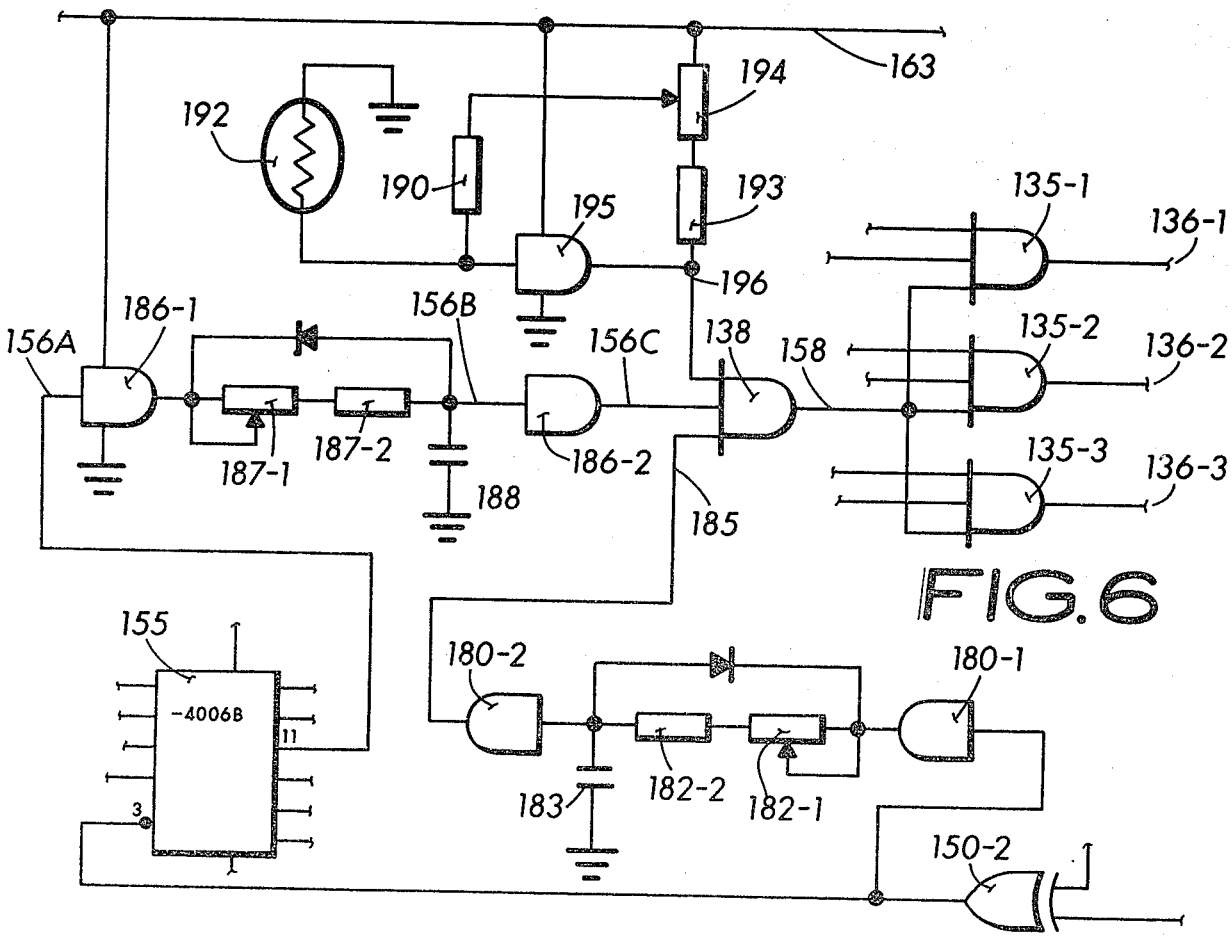
FIG. 6—Circuit detail for implementing overall lamp dimming control and photoelectric control with the FIG. 2 circuit.

The variable dimming and photoelectric (i.e., "dusk-to-dawn") control of the invention is taught in FIG. 6. The clock signal 151 is coupled through AND gate (buffer) 180. When the CLOCK goes HIGH, the output of 180-1 goes HIGH, charging capacitor 183 through the resistors 182-1, 182-2. After some phase delay, relative to the power line a.c. cycle from whence the clock signal is derived, gate 180-2 will go HIGH at the output 185 coupled with AND gate 138 allowing signal 156-B to couple with line 158, thence to gates 135-1, 135-2, 135-3 when line 196 is HIGH. The phase delay so effected retards the turn-on of the variative signals 136-1, 136-2, 136-3 on each power line (half) cycle, bringing about an effective load power variation, e.g. lamp dimming action. The photoelectric control is wrought by a light sensitive resistor 192. When in the relative dark, the resistance is high and resistor 190 pulls the AND (buffer) gate 195 input and output HIGH enabling line 196, also raising the voltage at the tap on resistor 194 inducing hysteresis or "snap-action". When ambient light reaches the photocell 192 above a predetermined level, as might be brought by the onset of dawn, the photocell resistance normally goes down, pulling the gate 195 input down until it switches over, producing a LOW on line 196 and inhibiting gate 138 and therefrom gates 135-1, 135-2, 135-3. This LOW on line 196 pulls resistors 193, 194 down again bringing about "snap-action" in the other direction.

The inclusion of AND gates (buffers) 186-1, 186-2 in the connection of the pseudorandom signal line 156-A with AND gate 138 input 156-C acts with resistors 187-1, 187-2 to charge capacitor 188 the effect of which is to phase-delay the turn-on effect of any pseudorandom pulses. The R/C time constant provided by the series combination of resistors 187-1, 187-2 together with capacitor 188 is predetermined to be usually several times that of the duration of any clock pulse period. This additional function serves to allow some adjustment of the "depth" of the flicker effect, e.g. some modification of the modulation introduced may be produced.

It is of course obvious that the dimming action and photoelectric control may be used separately, as well as together as shown.

While particularly taught as a three-load, e.g. 1,-2-3-1-2-3, etc. type of controller, no limitation to such an arrangement is intended. The practicing artisian may readily adapt the spirit of the teaching to alternant, back-and-forth, e.g. 1-2-1-2-1-2, etc. type controller which will give a different visual illusion having less apparent movement but usually heightened fluttering effect. Conversely, the artisian may also be expected to extend the spirit of the teaching to a higher order, e.g. 1-2-3-4-1-2-3-4, etc. or higher sequential chaser type of controller which tends to heighten the sense of visual movement, particularly when viewed from a substantial distance.

The adaptation of the instant teaching to employ transformer coupling, capacitor coupling, or even direct coupling between the switch driver and the thyristor gate is consistant with the spirit of the invention.

The use of a power transistor, or other such semiconductor control means in lieu of the thyristor as a switch means is anticipated, particularly where such use might include a d.c. source of power.

It is furthermore obvious to employ the spirit of this invention to bring together a substantially separate and otherwise conventional sequential controller, or chaser apparatus with still another substantially separate flicker controller apparatus such as that taught in Weber U.S. Pat. No. 4,253,045 to accomplish the overall illusory lighting method improvement taught by the instant invention.

What I claim is:

1. Electric controller means adapted for imparting the visual sense of illusory motion of an electric lighting means combined with the further visual sense of the flickering of the electric lighting elements, including in combination:

a. a source of electric power;

b. a plurality of electric lighting load circuit means usually arranged with seriate adjacency;

c. a plurality of electric switch means each of which is effectively coupled between said source and effectively one of the said plurality of circuit load means;

d. a source producing a plurality of sequential pulse first signals;

e. a source of pseudorandom pulse second signals; and, f. a unitive means coupled at least with said first signal source and said second signal source to effectively combine the plural sequential pulses and the pseudorandom pulses therefrom received into a plurality of separately efficacious variative control pulse signals each of which couples with an effectively separate said electric switch means to effect the control thereof.

2. Controller means of claim 1 wherein said source is alternating current electric power.

3. Controller means of claim 1 wherein said electric lighting load circuit means comprises an array of electric light bulbs.

4. Controller means of claim 3 wherein said electric lighting load circuit means further comprises a seriate array of at least three electric light bults, each orderly coupled with a separate said load circuit means to produce at least a 1-2-3-1-2-3-1-2-3-1-2-3 . . . 1-2-3, etc. sequential light switching pattern whilst a pseudorandom duration on and off switching pattern is superimposed thereupon; whereby said sequential pattern imparts the illusion of motion, whilst the pseudorandom pattern imparts the illusion of flutter to the overall effective light bulb array as viewed by an observer.

5. Controller means of claim 2 wherein said electric switch means includes a thyristor means having at least a first terminal coupled with said source means; a second terminal coupled with said load means; and a third terminal serving as a "gate" for the control thereof.

6. Controller means of claim 5 wherein said thyristor means effectively includes a light activated gate means; wherein further said unitive means includes a light source electrically coupled with and modulated by said variative control pulse signal and optically coupled with said light activated gate means; thereby affording substantial electric isolation between said thyristor means and said unitive means.

7. Controller means of claim 1 wherein said visual sense of illusory motion imparted by the teaching is that of a back-and-forth movement lighting effect produced by the alternation of the variative control signals between but two electric switch means coupled with the alternately adjacent load circuit means.

8. Controller means of claim 1 wherein said visual sense of illusory motion imparted by the teaching is that of a travelling "chaser" movement lighting effect produced by the sequential repetition of the variative control signals between at least three electric switch means coupled with a seriate chain of load circuit means.

9. Controller means of claim 1 wherein said sequential pulse first signal is effectively produced by a binary counter means usually coupled with a decoder means.

10. Controller means of claim 1 wherein said pseudorandom pulse second signal is effectively produced by a pseudorandom binary sequence generator means including a shift register means effectively coupled to feedback between at least two outputs and the input thereof whereby such feedback produces an irregular recirculation of signal states therethrough.

11. Controller means of claim 1, wherein said pseudorandom pulse signal source includes a binary memory means having a predetermined pseudorandom pattern of bit states programmed thereinto.

12. Controller of claim 2 wherein said variative control pulse signal is effected to be substantially synchronous with the a.c. line frequency of the electric power source.

13. Controller of claim 1 including a CLOCK means producing therefrom clock signals coupled with the said first signal source and said second signal source for the operation thereof.

14. Controller of claim 1 including a source of level pulse signal effectively coupled with said unitive means, therewith effective to provide for the alteration of the average power delivered by the said switch means from the source means to the load means.

15. Controller of claim 14 wherein said level pulse signal is effectively adjustable thereby bringing about the visual sense of average brightness variation of the load means.

16. Controller of claim 1 wherein said electric switch means includes a transistor means effectively coupled as a controllable electric current pass means between said source means and said load means.

17. Controller of claim 1 including a photoelectric means coupled with said unitive means, effective to turn the overall said controller means effect "on" and "off" in response to the prevailing ambient light level.

18. Electric controller method for producing enhanced dramatization of the viewed lighting effect wrought by a lighting array comprising a plurality of electric lamps in an electric lighting means, including the steps of:

a. providing for the sequential control of each lamp in any seriate group of several lamps comprising at least a portion of the said array thereby imparting a visual sense of motion;

b. providing the further substantially pseudorandom irregular control of the overall illumination produced by each electric lamp thereby imparting a visual sense of flicker; and, c. combining the sequential control which produces a sense of motion and the irregular control which prouduces a sense of flicker to act combinatively in the lighting array to produce an improved sense of overall moving flutter.

19. Electric controller method of claim 18 comprising the additional step for controlling the average level of the overall illumination produced by said seriate group.

* * * * *